United States Patent [19]

Ardelean

[11] Patent Number: 4,676,125

[45] Date of Patent: Jun. 30, 1987

[54] ADJUSTABLE SOCKET

[76] Inventor: Jeffrey L. Ardelean, 511 Dean St., St. Charles, Ill. 60174

[21] Appl. No.: 848,734

[22] Filed: Apr. 7, 1986

[51] Int. Cl.[4] ..... B25B 13/50

[52] U.S. Cl. ..... 81/53.2; 81/57.18; 81/57.2; 81/90.2

[58] Field of Search ..... 81/90.2, 90.3, 90.9, 81/57.18, 57.2, 57.36, 114, 115, 112, 53.2, 113, 111, 90.1, 90.5, 116, 92–94; 279/36, 37, 107; 269/156, 229, 234, 235

[56] References Cited

U.S. PATENT DOCUMENTS

| | | | |
|---|---|---|---|
| 531,577 | 12/1894 | Teal | 81/53.2 |
| 590,710 | 9/1897 | Sheppard | 81/90.3 |
| 595,363 | 12/1897 | Bartlett | 81/53.2 |
| 651,306 | 6/1900 | Gabriel | 81/53.2 |
| 1,162,197 | 11/1915 | Wahlstrom | 81/53.2 |
| 1,236,322 | 8/1917 | Launhart | 81/53.2 |
| 2,027,534 | 1/1936 | Ingersoll | 81/53 |
| 2,792,735 | 5/1957 | Ice | 81/91 |
| 2,884,826 | 5/1959 | Bruhn | 81/128 |
| 2,989,880 | 6/1961 | Hesser et al. | 81/57.18 |
| 3,664,213 | 5/1972 | Anati | 81/91 R |
| 3,698,266 | 10/1972 | Mader | 81/53 A |
| 3,724,299 | 4/1973 | Nelson | 81/128 |
| 4,213,355 | 7/1980 | Colvin | 81/128 |
| 4,366,733 | 1/1983 | Colvin | 81/128 |
| 4,378,714 | 4/1983 | Colvin | 81/128 |

*Primary Examiner*—Frederick R. Schmidt
*Assistant Examiner*—Bradley I. Vaught
*Attorney, Agent, or Firm*—Andrew F. Zikas

[57] ABSTRACT

An improved adjustable socket for use with a ratchet wrench drive handle to loosen or tighten bolts, nuts and other threaded workpieces, is comprised of a hollow cylindrical casing having a passive end adapted to receive a wrench handle protuberance, an opposing work end adapted to fit about a workpiece and a sidewall interconnecting such ends with one another and defining a cavity therebetween. A plurality of uniformly spaced apart through-openings are provided in the casing sidewall between the opposing ends thereof and a cylindrically shaped gripping member is pivotally mounted along a vertical eccentric axis thereof within each through-opening so as to be selectively moveable into and out of the casing cavity. In use, the adjustable socket is mounted onto a wrench handle and positioned about a threaded workpiece. An adjustment ring is then rotatably moved, say downwardly, so that a beveled surface thereof contacts a corresponding beveled surface of each gripping member and causes each gripping member to radially move inwardly into the casing cavity whereby a convex work face of each gripping member contacts the periphery of the workpiece. Upon application of torque to the wrench handle, each work face is continually urged into intimate gripping contact with the workpiece so as to drive it in a desired direction. Upon release/reversal of the torque force and upward movement of the adjustment ring, each gripping member is urged, via a biasing means, radially outwardly of the casing cavity so as to disengage from the workpiece.

9 Claims, 5 Drawing Figures

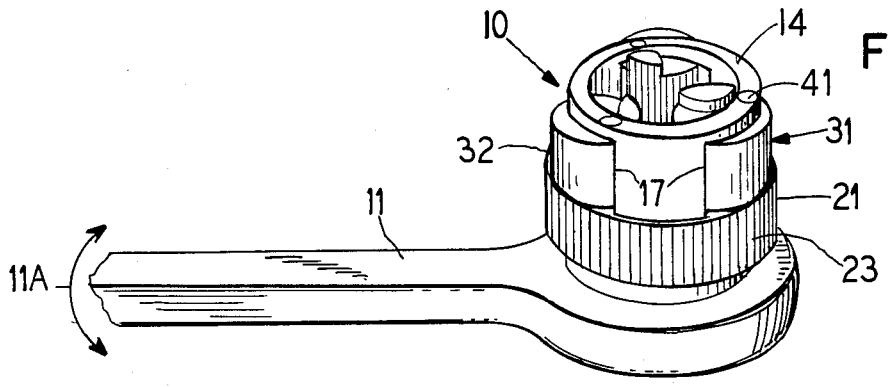
FIG. 1
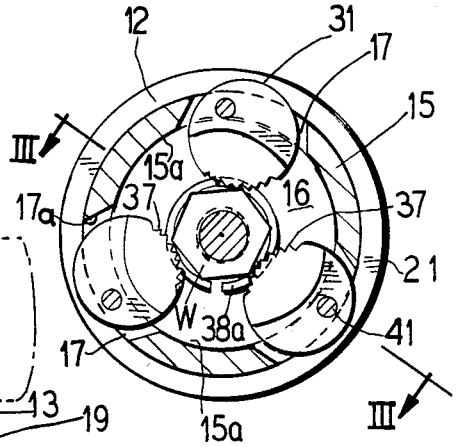
FIG. 2
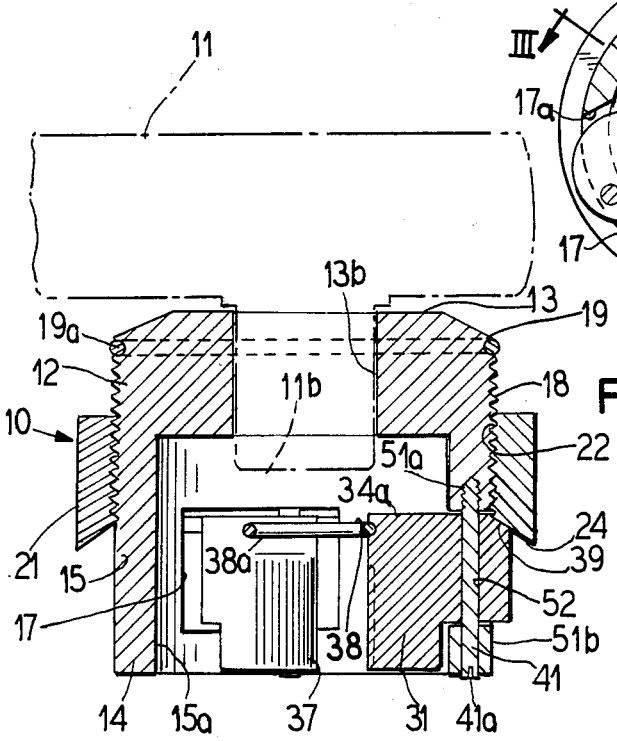
FIG. 3
FIG. 4
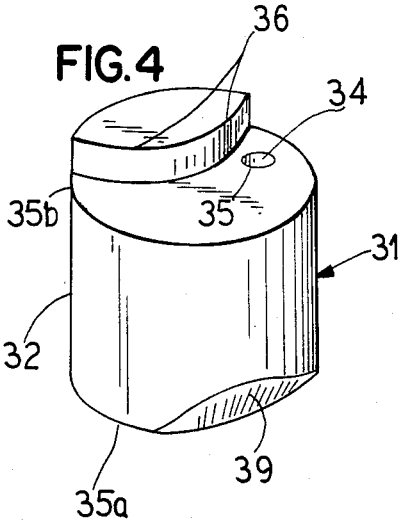
FIG. 5
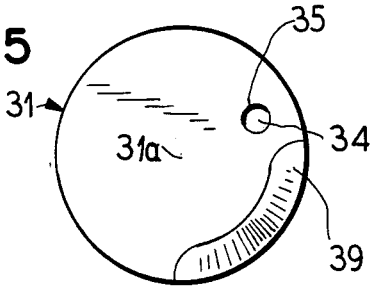

ADJUSTABLE SOCKET

BACKGROUND OF THE INVENTION

1. Field of the Invention

This invention relates to socket wrenches and somewhat more particularly to adjustable socket wrenches for driving bolts, nuts and other like threaded workpieces of various sizes.

2. Prior Art

Adjustable sockets for use on various sized nuts, bolts and other like workpieces and replacing more or less conventional socket sets, which include a plurality of different size sockets, each fitting a particular size workpiece, are known.

Adjustable sockets typically include a plurality of jaws that are moveable in a radial direction to grip and drive nuts or bolts of different size. The number of positions to which the jaws can be adjusted is usually large enough so that a fairly large range of both English and Metric size nuts and bolts can be driven by such sockets upon appropriate adjustment. Thus, a worker or mechanic can work on different sized nuts, bolts or the like, with a single adjustable socket without having to remove one socket from the wrench and replace it with another socket every time he encounters a different size nut or bolt. Further, the aggravation of misplacing or losing a particular socket or even searching for the right sized socket are eliminated by adjustable sockets.

U.S. Pat. Nos. 4,213,355, 4,366,733, and 4,378,714 disclose adjustable socket devices wherein straight or plane faced jaws are slideably moved by camming surfaces into contact with the peripheral surface of a workpiece and locked into position for driving such workpiece in a desired direction. However, these structures are relatively costly and complex, subject to jamming and the like. Further, if the workpiece periphery does not correspond to the plane of the jaw face, or the periphery of the workpiece presents an angle to the jaw face, slippage or the like occurs since the jaws are merely locked in a given position and not continually urged into further contact with the workpiece.

Other adjustable socket structures and like devices are disclosed by U.S. Pat. Nos. 531,577; 595,363; 651,306; 1,162,197; 1,236,322; 2,027,534; 2,792,735; 2,884,826; 3,664,213; 3,698,266; and 3,724,299. However, all of these diverse structures have various drawbacks, which are substantially minimized and/or eliminated by structures constructed in accordance with the principles of the present invention.

SUMMARY OF THE INVENTION

The invention provides an economical, relatively simple, substantially slip-proof and jam-proof adjustable socket for use with a ratchet drive handle to drive various sized bolts, nuts and other threaded workpieces in a desired direction wherein the work faces of a plurality of gripping members are moved into operative contact position about a workpiece, and, upon application of torque to the wrench handle, are continuously forced into further gripping contact with the workpiece in accordance with the applied torque.

An improved adjustable socket structure constructed and operative in accordance with the principles of the invention includes a monolithic cylindrical hollow casing having a passive or top end having a polygon wrench opening adapted for receiving a protuberance or drive stud of a ratchet wrench drive handle, a work or bottom end adapted to fit about the periphery of a threaded workpiece and a sidewall interconnecting the opposing ends with one another and defining a work-receiving cavity between such ends. A plurality of substantially uniformly spaced apart through-openings are provided in the casing sidewall between the opposing ends thereof. A gripping member is pivotally mounted along a vertical eccentric axis thereof within each through-opening so as to be selectively moveable into and out of the casing cavity. Each gripping member is provided with a work face, preferably of a convex configuration, and a stepped end having a somewhat arcuate stop surface which cooperates with an inner face of the casing sidewall to limit the movement of each gripping member between opened and closed positions. Each gripping member is also provided with a beveled outer surface portion, preferably adjacent an end thereof generally opposite the stepped end. An adjustment ring is threadingly mounted about an outer face of the casing sidewall for axial movement up and down such face and is provided with a beveled inner surface portion for slideably cooperating with the beveled surface of each gripping member. A biasing means may be mounted within the casing cavity and in contact with a sidewall portion of each gripping member so as to continually urge each gripping member out of the casing cavity.

During normal usage the adjustable socket device of the invention is mounted onto a conventional ratchet wrench drive handle and positioned so that the work end thereof is located over the periphery of a threaded workpiece. The adjustment ring is then moved or rotated, say downwardly, so that the ring beveled surface contacts the beveled surface of each gripping member and forces each gripping member radially into the casing cavity to abut against the periphery of the workpiece therein. Upon application of torque in a select working direction to the ratchet wrench handle, each gripping member is pivoted about its respective eccentric axis and the work face thereof is continually urged into gripping contact with the workpiece. The shape of the workpiece periphery has substantially no bearing on the bite between the work face of each gripping member and the workpiece periphery. Slippage and the like simply cannot occur without destruction of the workpiece or the work face of each gripping member. Upon completion of an operation, the torque force is reversed or released from the wrench handle and the adjustment ring is moved, say upwardly, so as to axially move the beveled surfaces thereof away from the beveled surface of each gripping member. In embodiments where a biasing means is utilized, it urges the gripping members out of the casing cavity. In other embodiments, once the beveled surfaces between the adjustment ring and each gripping member disengage, each gripping member is free to pivot outwardly so as to release or disengage from the workpiece without jamming.

In a preferred embodiment, the gripping members are cylindrical bodies having convex work faces, which may be knurled or otherwise roughened to resist slippage against another surface.

The objects, features and advantages of the present invention will be apparent from the following description and claims, and are illustrated in the accompanying drawings which, by way of illustration, shows certain preferred embodiments of the invention and the principles thereof and what is now considered to be the best mode contemplated for applying these principles. Other embodiments of the present invention embodying the same or equivalent principles may be used and structural changes may be made as desired by those skilled in the art without departing from the scope and spirit of the invention and falling within the purview of the appended claims.

BRIEF DESCRIPTION OF THE DRAWINGS

FIG. 1 is a fragmentary prospective view illustrating one embodiment of an adjustable socket constructed in accordance with the principles of the invention and shown mounted on a conventional ratchet wrench drive handle;

FIG. 2 is a fragmentary end view, partially in cross-section, of an embodiment of the present invention shown in working position relative to a workpiece;

FIG. 3 is an elevated view, partially in cross-section and partially in phantom, generally taken along line III—III of FIG. 2 and shown with a portion of a conventional ratchet wrench drive handle in phantom;

FIG. 4 is a somewhat isometric view of an embodiment of a gripping member utilized in an adjustable socket of the invention; and FIG. 5 is an end plan view of the gripping member shown in FIG. 4.

DESCRIPTION OF PREFERRED EMBODIMENTS

In the drawings, like reference numerals throughout the various Figures refer to like elements.

Referring now to the drawings in some detail, there is shown in FIGS. 1 and 3 an adjustable socket device 10 of the invention associated with or mounted on a more or less conventional ratchet drive handle 11 capable of selectively driving the device 10 in either direction, as schematically illustrated by double-headed arrow 11A. The improved adjustable socket device 10 of the invention may be constructed or formed from a material having the requisite characteristics for its intended function, and for example, may be cast, machined or otherwise formed from appropriate steels, special alloys, plastics, ceramics and/or combinations thereof.

An adjustable socket device constructed and operative in accordance with the principles of the invention is a relatively lightweight, economical, highly durable and substantially slip-proof and jam-proof, non-binding mechanism useful to loosen and/or tighten various shaped and sized bolts, nuts and other like threaded workpieces.

An exemplary adjustable socket device 10 of the invention is comprised of a hollow casing body 12, generally cylindrical in shape, having an upper or passive end 13, an opposing lower or work end 14 and a sidewall 15 interconnecting the ends 13 and 14 with one another while defining a cavity 16 therebetween. The upper end 13 is provided with a given size polygon shaped opening, such as a square $\frac{3}{4}$ inch diameter opening for receiving a like sized stud or protuberance **11*b*** on a ratchet wrench drive handle.

The casing body 12 is provided with a plurality of generally uniformly spaced-apart through-openings 17 located within the casing sidewall 15 and between the opposing ends 13 and 14 thereof. Each through-opening 17 provides ingress and egress to and from the cavity 16 of the casing body 12. The lateral edges **17*a* of each through-opening 17 may be angled inwardly as shown at FIG. 2 to allow a greater extent of movement of a roller 31 mounted within each through-opening. In presently preferred embodiments, three such through-openings 17 are provided and are substantially uniformly spaced about 120 degrees apart, around the periphery of the casing body. The lateral and axial extent of the openings 17** may vary substantially as desired and in accordance with the functional requirements of the adjustable socket device of the invention.

As best seen in FIG. 3, the casing body 12 may be provided with a relatively fine thread 18 along an outer sidewall surface portion, located generally above the upper extent of the through-openings 17. A groove 19 may be provided along the upper area of the threaded wall portion for receiving and retaining a stop means **19*a***, for example a split O-ring or snap-ring.

As shown in FIGS. 1 and 3, an outer adjustment ring 21 having an inner threaded surface 22 mating with the threaded portion 18 of casing body 12, is mounted for rotary vertical movement along the casing sidewall 15. The outer surface of the adjustment ring 21 may be provided with a friction enhancement means 23, such as a knurled surface or a coating of a material having a relatively high coefficient of friction, such as a plasticized rubber or rubber-like material. The adjustment ring 21 is also provided with a beveled end face 24, generally extending from the threaded surface 22 outwardly at an angle less than 90 degrees to the outer surface of the ring.

A gripping member or roller 31 (best seen in FIGS. 3, 4 and 5) is mounted within each through-opening 17 of casing body 12 for pivotal movement about a vertical eccentric axis 34 of such gripping member. Each respective gripping member freely pivots about is eccentric axis 34 to enable each gripping member to move into and out of the casing cavity 16. Each gripping member is provided with a monolithic body 32, preferably of a somewhat cylindrical shape, with a vertical center axis **31*a* and a substantially parallel eccentric axis 34, offset from the center axis 31*a* toward an edge of the body 32. In the embodiment shown, each gripping member 31 is provided with an upper planar end surface 35*a* and a lower stepped end surface 35*b*. The stepped end surface 35*b* of each gripping member or roller 31 may be provided with a somewhat arcuate stop surface 36. The stop surface 36 of each gripping member cooperates with the inner face 15*a* of the casing sidewall 15 to limit the extent of movement of each gripping member between opened and closed positions. FIG. 2 illustrates the gripping members 31 in a closed position about a threaded workpiece W. The inner edges of the respective stop surfaces 36 may be planar, or, preferably, somewhat convexly curved as best seen in FIG. 4 to match the curvature of the inner face of casing sidewall 15. In preferred embodiments, the central angle defined between the cord subtended by the arch of the stop surface 36 may range from about 60 degrees to 160 degrees and, more preferably, range from about 80 degrees to 140 degrees and most preferably range from about 90 degrees to 120 degrees. The inner edges of the stop surfaces 36** may comprise a segment of a regular circle or be somewhat parabolic or ellipsoid in shape.

As best seen in FIG. 3, a retaining groove 38 may be provided along an upper sidewall portion of each gripping member 31. A biasing means **38*a*, such as a spring snap-ring may be mounted within the groove 38 of each gripping member 31 so as to continually and substantially uniformly urge all of the gripping members outwardly from the casing cavity 16**.

Also as shown at FIG. 3, each gripping member 31 is provided with a roughened or knurled work face 37 for engaging a select workpiece. Each gripping member 31 is also provided with an axially extending mounting passageway 35, generally concentric with the eccentric axis 34 of each member 31. The mounting passageway or hole 35 extends through the body 32 of member 31 and defines a smooth axial passageway. Keyholes 51*a* and 51*b* corresponding to mounting hole 35, are provided within casing sidewall 16, extending upwardly from the bottom face of end 14 across each respective through-opening 17 and into an adjacent upper wall portion. Keyholes 51*a* and 51*b* are substantially parallel with the vertical axis of the casing body and are alignable with hole 35 to define a pivot mounting bore 52. A shaft means 41 fits within the mounting bore 52 and anchors each gripping member into an associated through-opening of casing 12 so as to allow each gripping member to pivot about the shaft means 41. The shaft means 41 may be press fitted into the mounting bore so as to more or less permanently secure a gripping member to the casing body or as shown in FIG. 3, a shaft means 41 may comprise a threaded key or threaded rod having a recessed slot 41*a* for engagement by a screwdriver blade or a hexagonal allen key or the like. In embodiment utilizing a threaded key, one of the key holes 51*a*, 51*b*, in the casing sidewall 15 may be provided with an inner threaded surface to mate with corresponding threads on the exterior of an end portion of the pivot shaft and thereby allow each gripping member to be selectively removed or replaced as necessary.

Each gripping member 31 is also provided with an outer beveled surface portion 39, generally complementary with the beveled surface portion 24 of the adjustment ring 21. The beveled surface portions 39 and 24 generally define an acute angle with the vertical axis of the casing 12 and preferably define an angle in the range of about 30 degrees to 60 degrees with such axis.

During typical usage, a worker or mechanic mounts the passive or top end 13 of an adjustable socket device of the invention on a polygon shaped stud 11B of a more or less conventional ratchet socket drive handle 11 as shown in phantom in FIG. 3. The work end 14 of such socket device may then be loosely mounted or positioned over a threaded workpiece, such as workpiece W in FIG. 2, and the adjustment ring 21 may then be moved or rotated, typically downwardly, so that its beveled surface 24 contacts the respective beveled surfaces 39 on each gripping member 31 and urges the members 31 to pivot radially inwardly within the casing cavity 16 until the respective work faces 37 of each gripping member contact the peripheral surface of a workpiece within the casing cavity. During such inward movement of the gripping members, the biasing means 38*a* may be compressed. Once firm contact is established between the work faces of the respective gripping members and the periphery of the workpiece, additional torque may be applied to the drive handle and cause each gripping member to attempt further pivotal movement about each respective eccentric pivot means 41 and substantially simultaneously exert further pressure on the workpiece so as to drive it in the direction of the applied torque. In this manner, a substantially uniformly distributed multi-point bite is provided around the periphery of the workpiece so that slippage and the like cannot occur despite any surface characteristics of the workpiece. Once a workpiece has been driven (secured or loosened) to a desired extent, the torque force on the handle 11 may be released and/or reversed and the adjustment ring may be rotated upwardly to free the respective gripping members for outward movement. Once the adjustment ring is moved a sufficient extent, the gripping members 31 are free to pivot in an opposing direction from their initial drive direction. Since the biasing means 38*a* is mounted so as to continuously urge each of the gripping members radially outwardly away from each other and out of the casing cavity, no jamming or sticking of the roller work face with the workpiece can occur.

What is claimed is:

1. An adjustable socket device comprising, in combination:

a cylindrical casing having a first end adapted to cooperate with a torque applying means, an opposing second end adapted to fit about a threaded workpiece and a sidewall interconnecting said ends with one another and defining a vertically extending cavity between such ends for receiving a workpiece;

a plurality of substantially uniformly spaced apart through-openings located in said casing sidewall and between said casing ends, said through-openings providing communication between space exterior of said casing and said casing cavity;

a plurality of gripping members, each member being pivotally mounted about an eccentric vertical axis thereof, each gripping member being located within a respective through-opening so as to be selectively moveably into and out of said casing cavity, each of said gripping members being provided with at least one stepped end having a vertically extending stop surface, said stop surface extending generally parallel with the eccentric axis of said gripping member and cooperative with an inner face of said casing sidewall to limit movement of each gripping member between opened and closed positions; and adjustment means in working relation with said casing for substantially uniformly moving said gripping members into a select position relative to a workpiece positioned within said casing cavity;

whereby selective activation of said adjustment means moves said gripping members into contact with a threaded workpiece within the casing cavity and subsequent selective application of torque to said casing urges said gripping members substantially uniformly against said workpiece.

2. An adjustable socket device as defined in claim 1, wherein said stop surface comprises a convex surface having a radius curvature generally corresponding with that of said inner surface of the casing cavity.

3. An adjustable socket device as defined in claim 1 wherein said adjustment means for moving said gripping members includes an adjustment ring mounted for axial movement along the casing sidewall and into and out of contact with each gripping member.

4. An adjustable socket device as defined in claim 3 wherein a biasing means is mounted within the casing cavity and in contact with each respective gripping member to continually urge said members outwardly.

5. An adjustable socket device as defined in claim 4 wherein said biasing means comprises a spring snap-ring and each of said gripping members is provided with a horizontally extending groove along an upper sidewall portion thereof for receiving said snap-ring.

6. An adjustable socket device as defined in claim 1 wherein said adjustment means for moving said gripping members comprises an adjustment ring threadingly mounted about the outer surface of said casing sidewall and above an upper periphery of said through-openings for selectively moving said gripping members inwardly to contact a threaded workpiece within the casing cavity, and a spring means is mounted within the casing cavity in working contact with each gripping member urging said member outwardly to disengage said gripping member from the workpiece within the casing cavity.

7. An adjustable socket device as defined in claim 1 wherein said casing sidewall is provided with a threaded outer surface portion located above said through-openings and an adjustment ring having a threaded inner surface is mounted for rotary movement along said threaded outer surface portion of the casing.

8. An adjustable socket device as defined in claim 7 wherein said adjustment ring includes an inwardly beveled lower surface portion and the gripping members are each provided with an outwardly beveled surface portion, said beveled surface portion cooperating with one another on axial movement of said adjustment ring, to radially move said gripping members into and out of contact with a workpiece within the casing cavity.

9. An adjustable socket device comprising, in combination:

a cylindrical casing having a first end with an aperture adapted to mate with a stud of a ratchet wrench drive handle capable of transmitting torque forces to said casing, an opposing second end having a central opening adapted to fit about a threaded workpiece of a given diameter, and a sidewall interconnecting said ends with one another and defining an axially extending vertical cavity between said ends and in communication with at least said central opening;

a plurality of substantially uniformly spaced apart through-openings located in said casing sidewall and between said casing ends so as to provide communication between space exterior of said casing sidewall and said casing cavity, each of said through-openings being defined by at least upper and lower end walls having inner and outer sidewall surfaces, each of said end walls having an axial bore centered between said inner and outer sidewall surfaces and aligned with one another while extending substantially parallel with the axis of said casing cavity;

a plurality of substantially identical cylindrically shaped gripping members, each member having a monolithic body portion positioned within a respective through-opening and having a passageway extending vertically through such body portion and substantially concentric with an eccentric axis located adjacent a sidewall of said gripping member and parallel with a central axis thereof, each of said gripping members including an upper outwardly beveled side surface and a lower stepped end surface provided with a substantially vertical convexly curved stop surface extending toward said casing central opening and generally parallel with the casing sidewall, said stop surface cooperating with an inner face of said casing sidewall to limit movement of each gripping member between opened and closed positions;

a pin means mounted through the bores of the end walls of each through-opening and the passageway of the gripping member located therein to permit pivotal movement of each gripping member about said pin means;

an adjustment ring means threadingly mounted about the exterior face of said casing sidewall and above said upper end wall of each respective through-opening, said adjustment ring means having an inwardly beveled lower end surface generally corresponding with said beveled surface on each gripping member and cooperative therewith to radially move said gripping members into said casing cavity upon downward movement of said ring means along the casing sidewall; and a biasing means mounted within the casing cavity and in substantially uniform contact with each of said gripping members along an upper sidewall thereof for continually urging said gripping members outwardly from said casing cavity.

* * * * *